US006210236B1

(12) United States Patent
Kan

(10) Patent No.: US 6,210,236 B1
(45) Date of Patent: Apr. 3, 2001

(54) CASETTE AND TWO-LAYER TYPE OF WIRE-CONNECTION CHASSIS

(76) Inventor: Chin-Mao Kan, No. 2-1, Chung Fu Rd., Sec. 2, ChungLi City (TW)

( * ) Notice: Subject to any disclaimer, the term of this patent is extended or adjusted under 35 U.S.C. 154(b) by 0 days.

(21) Appl. No.: 09/398,093

(22) Filed: Sep. 17, 1999

(51) Int. Cl.[7] ..... H01R 23/02
(52) U.S. Cl. ..... 439/676; 439/79; 439/80
(58) Field of Search ..... 439/676, 79, 80, 439/607–610, 541.5

(56) References Cited

U.S. PATENT DOCUMENTS 4,820,173 * 4/1989 Thom et al. ..... 439/79
4,932,885 * 6/1990 Scholz ..... 439/79
4,968,266 * 11/1990 Yamamoto ..... 439/271
4,997,376 * 3/1991 Buck et al. ..... 439/59
5,531,612 * 7/1996 Goodall et al. ..... 439/541.5
5,562,507 * 10/1996 Kan ..... 439/676
5,823,799 * 10/1998 Tor et al. ..... 439/79

* cited by examiner

*Primary Examiner*—Brian Sircus
*Assistant Examiner*—Son V. Nguyen
(74) *Attorney, Agent, or Firm*—Dougherty & Troxell

(57) ABSTRACT

A cassette and two-layer type of wire-connection chassis, which mainly comprises a receptacle body, a seal plate, a plurality of upper-layer and lower-layer conductive pin bases and conductive pins; the conductive pin and the conductive pin bases are molded into one piece; the conductive pin bases are plugged into the receptacle body; one end of each conductive pin is bent backwards at a small angle to tauch against the inner surface of the receptacle body so as to provide a better contact by means of the resilience thereof, while the other end thereof is bent into a small recess shape; the opposite recess-shaped ends of the upper-layer and lower-layer conductive pins form into a pair of convex-shaped points to hold a PCB plugged therein; by means of the two opposite guide clamps on both sides of the seal plate, the PCB can be held firmly in the mid-section of the present invention so as to facilitate mounting electrical parts required on both sides of the PCB.

2 Claims, 7 Drawing Sheets

CASETTE AND TWO-LAYER TYPE OF WIRE-CONNECTION CHASSIS

BACKGROUND OF THE INVENTION

The two-layer type of wire-connection chassis as shown in FIG. 8 is a novel wire-connection chassis of the applicant's filed previously (under application No. 82313632 and new model application No. 103909); the prime feature of the aforesaid application is to improve the drawback of the conventional one-layer type of wire-connection chassis, which takes a considerable area and space of a PCB (printed circuit board), while the present invention will reduce the area and space required by the electronic parts without affecting the functions thereof. The structure of the previous invention as shown in FIG. 8 comprises a receptacle body 24, an upper-layer conductive pin base, a lower-layer conductive pin base, and a plurality of conductive pins respectively. As shown in FIG. 5, the wire-connection chassis can be plugged on a PCB 26 by means of a plurality of conductive pins 25; then, both of them are mounted in casings 29 and 30; the bottom surface of the PCB 26 is almost attached to the casing 30, and the space supported with some short post 28 them is too marrow to install any electronic parts; in other words, electrical parts 27 can only be mounted on the top surface of the PCB. In that case, the space available is limited, while the space in the casings 29 and 30 is wasted; as a result, the dimensions of the equipment will be increased without providing additional functions of the equipment, and therefore improvement thereof is required.

SUMMARY OF THE INVENTION

In view of the drawbacks of the aforesaid conventional two-layer type of wire-connection chassis and the PCB thereof, some improvements are required; therefore, the inventor has developed further improvements for the previous two-layer type of wire-connection chassis. The improved chassis not only can provide it with a simple structure, but also can provide a structure, in which the upper-layer and the lower-layer pins extend out of the mid-section of the seal plate of the wire-connection chassis so as to facilitate a PCB to assemble with the chassis; then, both sides of the PCB mounted in the middle of the casing can be mounted or soldered with electrical parts; in other words, the limited space in the casing will be used completely and fully, and it is deemed quite useful to the current equipment which all require a popularity of small and thin dimensions.

DETAILED DESCRIPTION OF THE PREFERRED EMBODIMENT

Figure 1A:
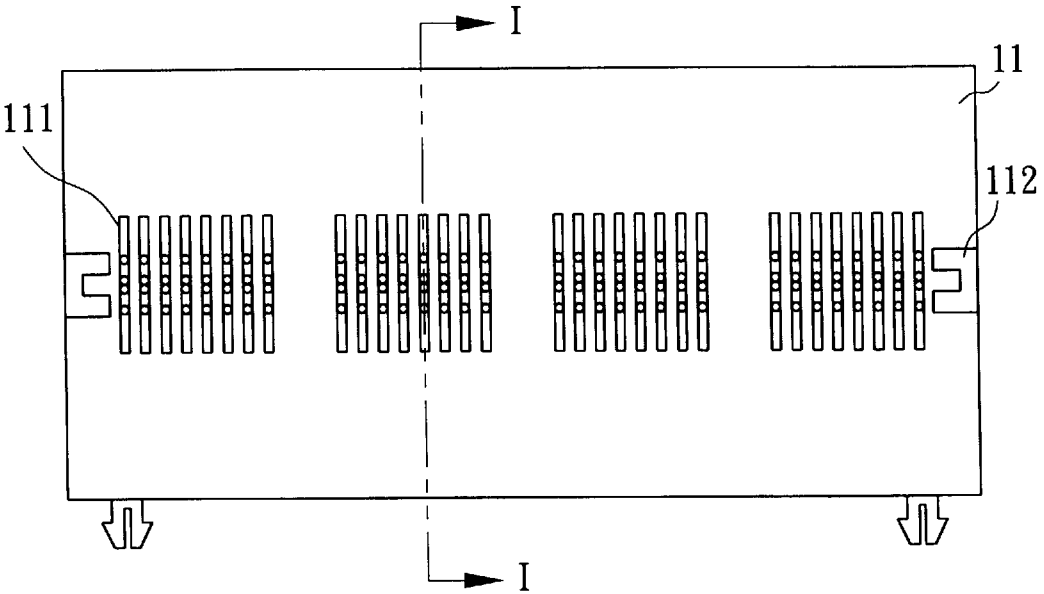
FIG. 1 is a sectional view of the present invention, showing two sides thereof.
Figure 1B:
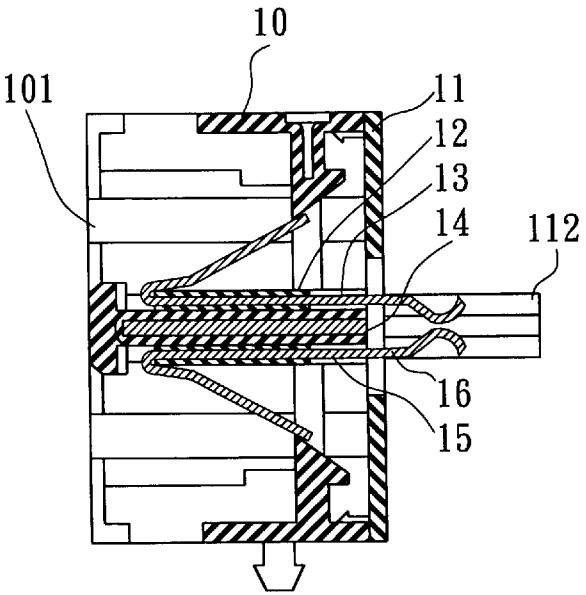
Figure 2:
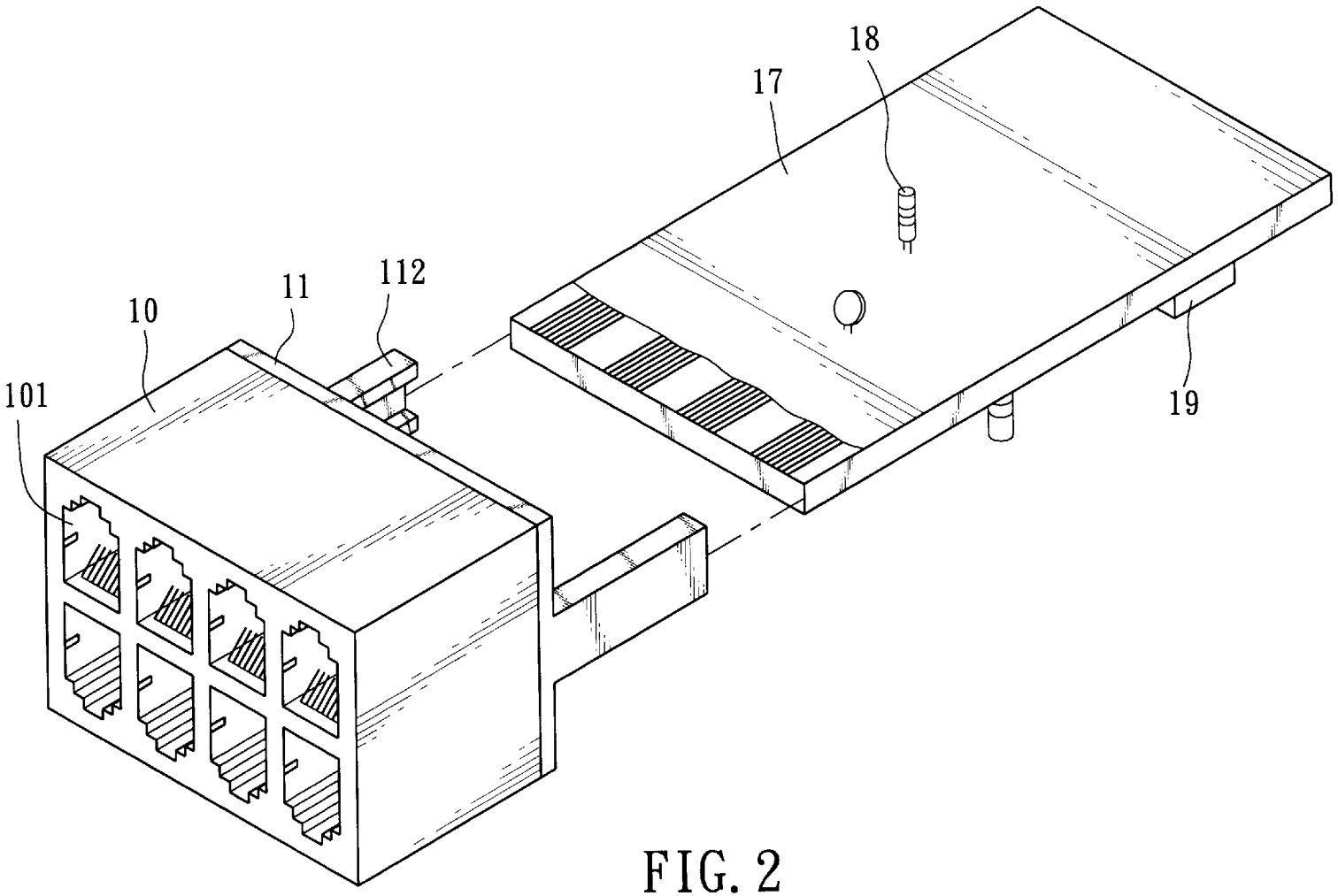
FIG. 2 is a perspective view of the present invention, being disassembled from a printed circuit board.
Figure 3A:
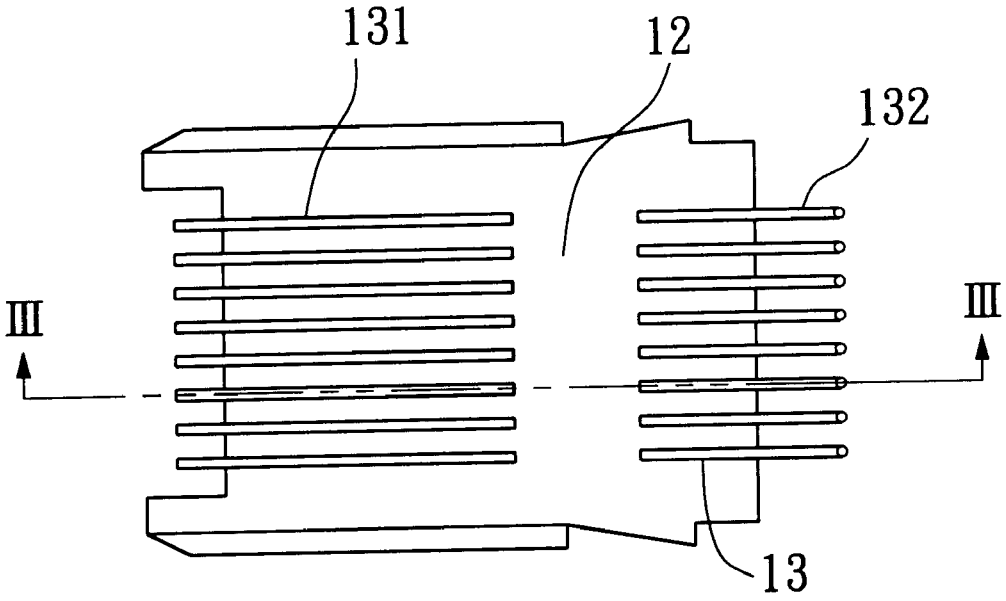
FIG. 3 is a sectional view of the present invention, showing two sides of an upper-layer conductive pin base thereof.
Figure 3B:
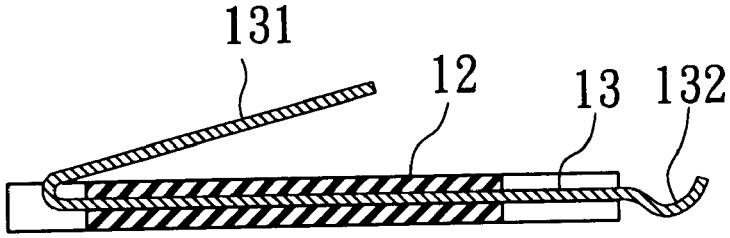
Figure 4:
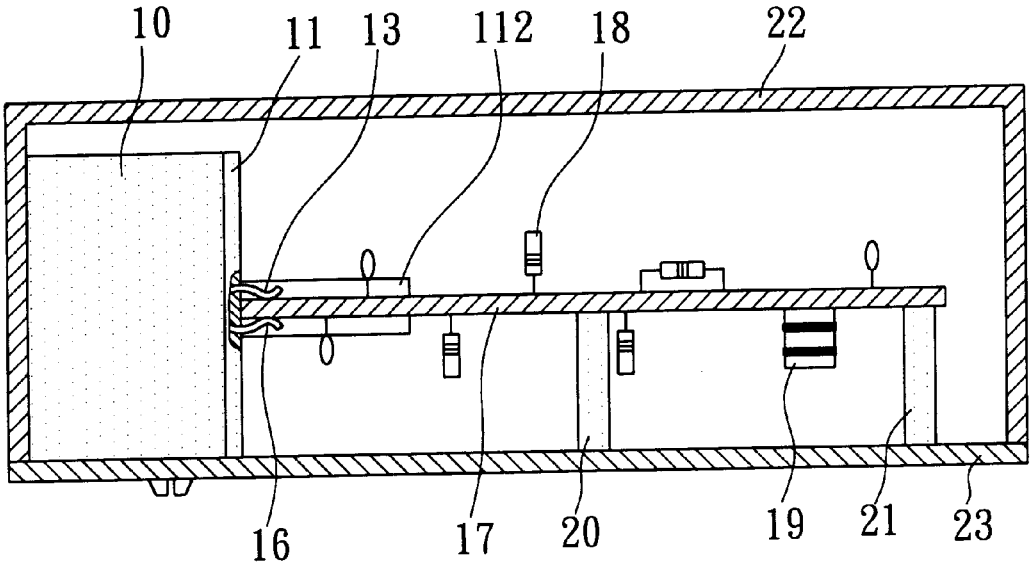
FIG. 4 is a sectional view of the present invention mounted in a body portion together with a printed circuit board.
Figure 5:
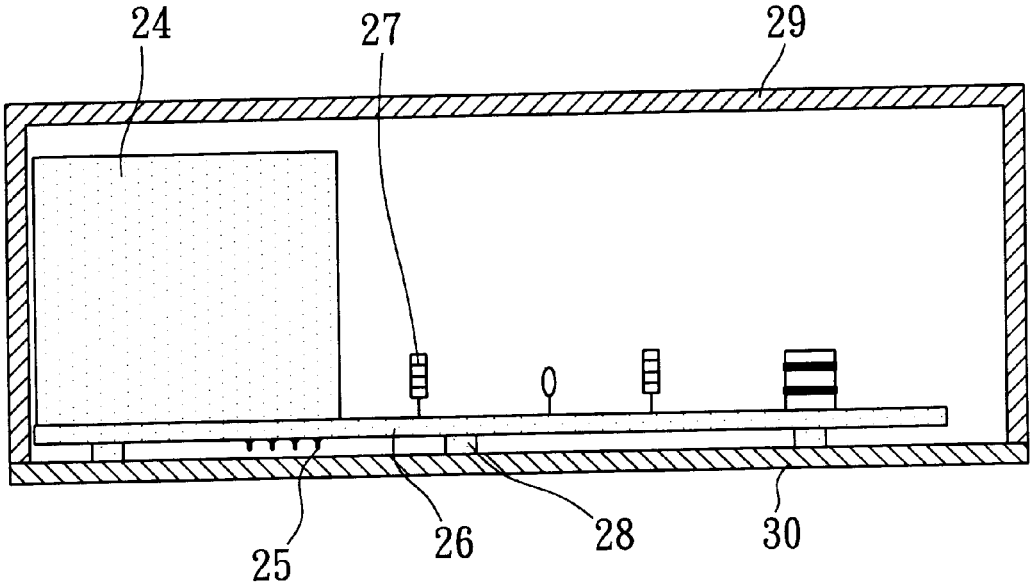
FIG. 5 (PRIOR ART)
FIG. 5 is s sectional view of the present invention, showing a plug-type wire-connection chassis and a printed circuit board mounted in a body portion.
Figure 6A:
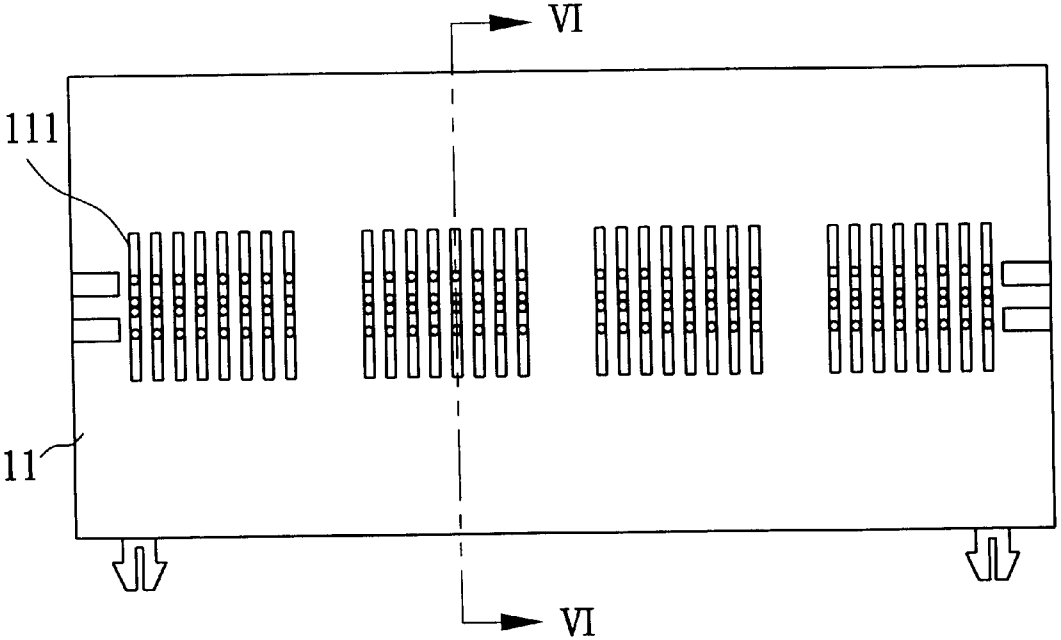
FIG. 6 is a sectional view of another embodiment of the present invention, showing the two sides thereof.
Figure 6B:
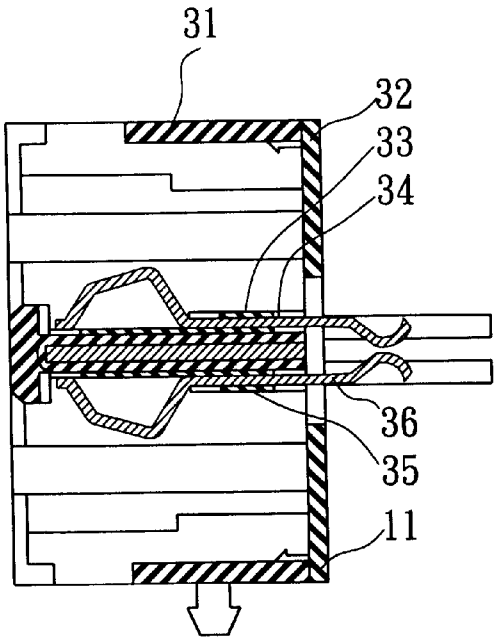
Figure 7A:
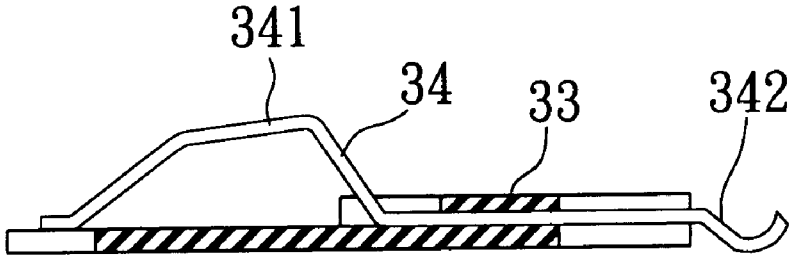
FIG. 7 is a sectional view of another embodiment of the conductive pin base of the present invention, showing the two sides thereof.
Figure 7B:
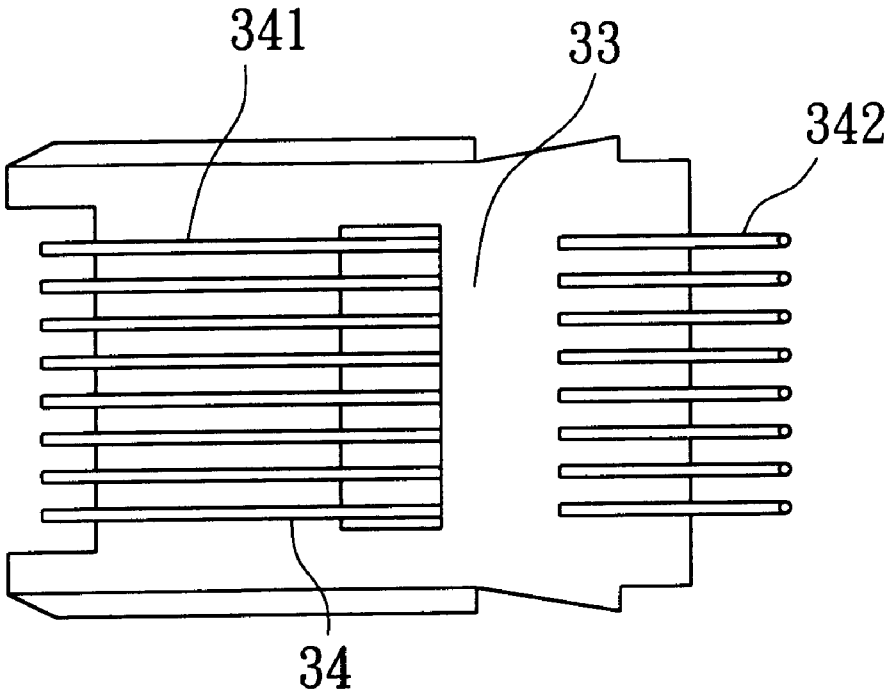
Figure 8A:
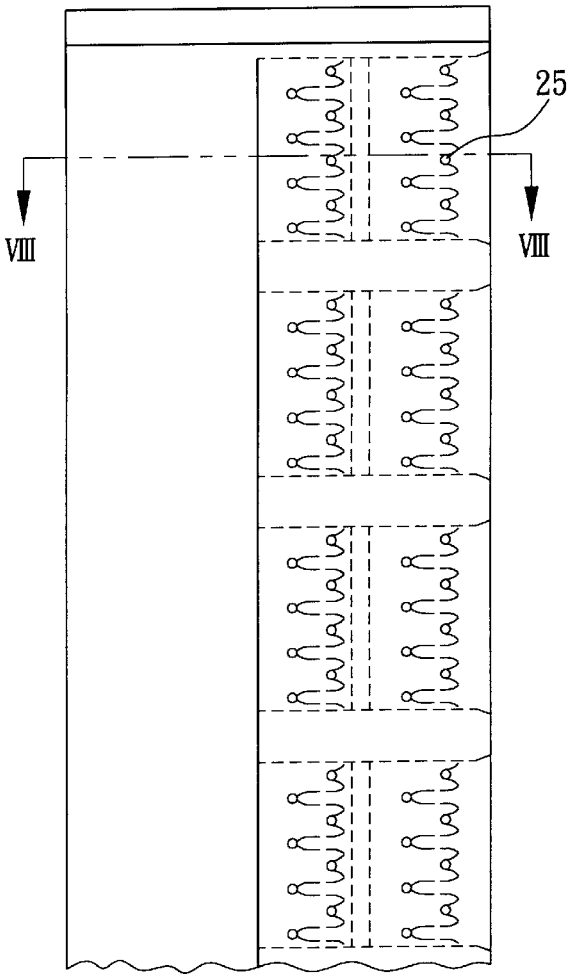
FIG. 8A (PRIOR ART)
FIG. 8 s a sectional view of a plug-type wire connection chassis, showing the tow sides thereof.
Figure 8B:
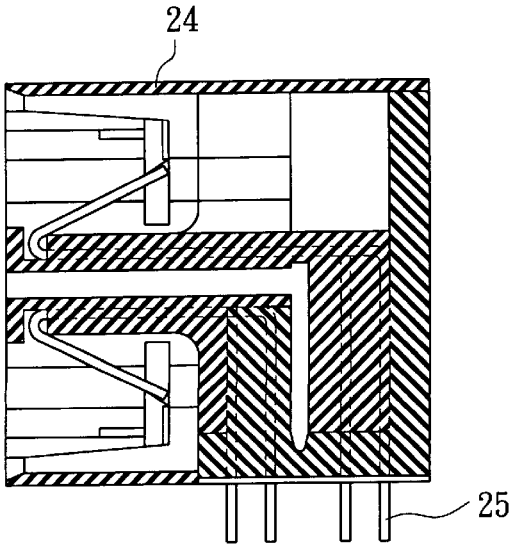
FIG. 8B (PRIOR ART)

This invention relates to a cassette and two-layer type of wire connection chassis, which comprises, as shown in FIG. 1, a receptacle body 10, a seal plate 11, a plurality of upper-layer conductive pin bases 12 and conductive pins 13, a plurality of lower-layer conductive pin base 15 and conductive pins 16, and a metal shield 14. Both the receptacle body 10 and the seal plate 11 are plastic parts by injection molding. One end of the receptacle body has a plurality of plug parts 101 for receiving plugs to provide electrical connection; the number of the plug part 101 can be designed into two or an even number in accordance with requirement (for example, eight (8) parts are provided in the present invention). The inner portion of the receptacle body is plugged with the upper-layer and lower layer conductive pin bases 12 and 15 respectively. A metal shield 14 is mounted between the upper-layer conductive pin bases and the lower-layer conductive pin bases so as to prevent from interference and crosstalk between the upper-layer conductive pins and the lower-layer conductive pins. The rear side of the receptacle body 10 is covered with a seal plate 11 so as to have the aforesaid parts sealed in the receptacle body 10, and only to have the rear ends of the conductive pins 13 and 16 extended out of the partition slots 111 of the seal plate so as to connect with a PCB (printed circuit board). The outer side of the seal plate 11 are finished, by molding, with a pair of opposite guide clamps 112 having recess channels respectively for champing and connecting with the PCB. The recess channel may be furnished with a form as shown in FIG. 6, i.e., a through recess channel so as to fit a PCB having different width. FIG. 2 is a perspective view of the present invention, being disassembled from a PCB; the plug parts 101 of the receptacle body 10 are used for receiving plugs. The PCB 17 is pushed and mounted in place by means of the guide clamp of the seal plate 11, and is held with the upper-layer and lower-layer conductive pins; the current of every conductive pins will then be transmitted to the various electrical parts 18 and 19 in the circuits of the PCB for rectification and transformation process. The model or shape of the upper-layer and lower-layer conductive pins bases and the pins thereof is all the same, but the two layers are arranged in opposite position. FIG. 3 is a sectional view and a plan view of the upper-layer conductive pin base 12 and the conductive pins 13 thereof. The conductive pin base 12 is a plastic parts formed by means of injection molding so as to have all pins therein fixed together; the prime feature thereof is that the mid-section of the conductive pin is sealed and fixed in place by means of the conductive pin base 13, while the front resilient section 131 of the conductive pin is the same as the ordinary conductive pin, i.e., being bent backwards at a given angle; the resilient section 131 of the pin is standing upwards in the receptacle to be in contact with a plug electrically. The fastened section 132 of the conductive pin is not covered, and the rear end thereof is bent into a curved shape or at an acute angle. FIG. 4 is a sectional view of the present invention,showing the present invention and a PCB 17 being mounted in casings 22 and 23; the PCB 17 is plugged into the guide clamps 112 and between the upper-layer conductive pins 13 and the lower-layer conductive pins 16; in that case, both the top and bottom surface of the PCB 17 can be mounted with electrical parts 18 and 19 respectively. In order to have the PCB mounted in place firmly, a plurality of short parts 20 and 21 can be mounted between the bottom side of the PCB and the casing 23. FIG. 6 shows another embodiment of the present invention, in which the receptacle body 31 is mounted with the upper-layer and lower-layer conductive pin bases 33 and 35, conductive pins 34 and 36 and a metal shield. The forms of the conductive pin and the conductive pin base are shown in FIG. 7; the resilient section 341 of the conductive pin 34 is bent into a convex-shaped form; when the resilient section is pressed with a plug, it will provide a resilient and class contact electrically; the fastened section 342 of the conductive pin is the same as shown in FIG. 3, i.e., either a curved shape or an acute angle shape.

Briefly, the present invention is a further improvement to the previous improvement on conventional one-layer type of wire connection chassis as a result of the drawbacks thereof disclosed later so as to save more space of the chassis to increase the functions thereof (i.e., more electric parts can be mounted under the PCB); furthermore, the structure of the present invention has been much simple so as to meet the requirements to of the modern small electronic products, and to lower the manfactural cast and also to provide a better conductive (i.e., the short conductive pin will have less impedance). It is apparent that the present invention is deemed novel, advanced and practical; thereof, a "letter patent" is solicited on the merits.

What is claimed is:

1. An assembly of a cassette and two-layer wire-connection chassis holding a printed circuit board, comprising:

a receptacle body made of injection molding plastics having a front end formed with a plurality of hollow plug ports, a mid-section and a rear end;

a removable seal plate made of injection molding plastics having resilient latch members engaged with notch members formed in the rear end, wherein the seal plate having a plurality of slots formed therein arranged in a linear array and a pair of spaced guide clamps extending outwardly from two opposite sides of the seal plate;

a plurality of upper-layer conductive pin bases made of injection molding plastics engaged with the mid-section of the receptacle body, each upper-layer conductive pin base having a plurality of upper conductive pins, each pin having a middle section embedded in the associated upper-layer conductive pin base, an upper front end formed in an upper resilient section bent at a pre-selected angle in a rearward direction to extend into one of the plurality of plug ports, and upper rear end of the pin forming a curved first fastened section extending outside the receptacle body through one of the plurality of slots;

a plurality of lower-layer conductive pin bases made of injection molding plastics engaged with the mid-section of the receptacle body and spaced from the upper-layer conductive pin bases, each lower layer conductive pin base having a plurality of lower conductive pins, each pin having a lower middle section embedded in an associated lower-layer conductive pin bases, a lower front end of the pin formed in a lower resilient section bent at a pre-selected angle in a rearward direction to extend into one of the plurality of plug ports and a lower rear end of the pin forming a curved second fastened section extending outside the receptacle body through one of the plurality of slots and spaced from the first fastened section;

a metal shield located in the mid-section of the receptacle body between the upper-layer conductive pin bases and lower-layer conductive pin bases;

a printed circuit board with circuits on each of two opposite facing sides and two end portions of opposite side edges engaging the guide clamps such that the first fastened sections contact the circuit on a first of the two opposite facing sides and the second fastened sections contact the circuit on a second of the two opposite facing sides, wherein each of the two opposite facing sides of the printed circuit board has electrical parts mounted thereon;

a casing enclosing the receptacle body and printed circuit board, the casing having a bottom portion; and, at least one support extending between the printed circuit board and the bottom portion enabling the printed circuit board to have electrical components mounted on a side facing the bottom portion.

2. The cassette and two-layer type of wire-connection chassis of claim 1, wherein the upper resilient section and lower resilient section are each respectively formed in a convex shape with the upper front end and lower front end pointing in a forward direction.

* * * * *